United States Patent [19]

Jackson

[11] Patent Number: 4,746,059

[45] Date of Patent: May 24, 1988

[54] COLLAPSIBLE CONTAINER AND A METHOD FOR LOADING A PRODUCT INTO AND UNLOADING THE PRODUCT FROM A COLLAPSIBLE CONTAINER

[75] Inventor: Miles N. Jackson, Cobourg, Canada

[73] Assignee: General Foods Inc., Don Mills, Canada

[21] Appl. No.: 33,321

[22] Filed: Apr. 1, 1987

[51] Int. Cl.[4] ..... B65D 5/36

[52] U.S. Cl. ..... 229/23 R; 229/41 B; 206/386; 220/4 F

[58] Field of Search ..... 229/23 R, 16 R, 41 B, 229/41 R; 206/386, 600, 491; 220/4 F, 6, 7

[56] References Cited

U.S. PATENT DOCUMENTS

| | | | |
|---|---|---|---|
| 2,887,264 | 5/1959 | Fallert | 229/23 R |
| 3,291,364 | 12/1966 | Fischer | 229/23 R |
| 3,777,969 | 12/1973 | Nurre | 229/23 R |
| 3,880,341 | 4/1975 | Bamburg et al. | 229/23 R |
| 4,186,846 | 2/1980 | Jacalone et al. | 229/23 R |
| 4,260,071 | 4/1981 | Bamburg et al. | 229/23 R |

*Primary Examiner*—Willis Little

*Attorney, Agent, or Firm*—Linn I. Grim; Daniel J. Donovan

[57] ABSTRACT

A collapsible container for holding a product, comprising an outside member and an inside member. The outside member includes a bottom section and four foldably interconnected outside panels vertically extending upward from the bottom and forming therewith a container interior to receive the product. The inside member includes four reinforcing panels and each of these panels includes a foldable upper flap. The reinforcing panels are positioned inside and abutting against the outside panels of the outside member, and the upper flaps of the inside member are positioned generally horizontally, extending over the container interior. A plurality of connecting clips releasably connect together these upper flaps to hold the flaps generally horizontal, and to hold the reinforcing panels and the outside panels against the weight of the product.

4 Claims, 3 Drawing Sheets

COLLAPSIBLE CONTAINER AND A METHOD FOR LOADING A PRODUCT INTO AND UNLOADING THE PRODUCT FROM A COLLAPSIBLE CONTAINER

BACKGROUND OF THE INVENTION

This invention generally relates to collapsible, reusable containers. More specifically, the invention relates to such containers that are especially well-suited for holding bulk, particulate materials, and to a method for loading a product into and unloading that product from a collapsible container.

Reusable, collapsible containers are being used with increasing frequency to ship bulk, particulate materials such as coffee beans, cereals, and gelatin powder. Typically, when in an expanded position or condition, these containers have a box shape and are designed to be stacked one on top of another. An advantage of such containers is that, when empty, they can be collapsed into a very compact shape in which the container occupies only a small portion of the space it occupies when in the expanded condition, and this keeps the cost of storing and transporting the containers themselves relatively low. A disadvantage of collapsible containers is that they often do not have the necessary rigidity to maintain their shape when used to hold dense products; and, for example, the sides of the container may bulge, or bow outwardly when the container is filled with such a product. This outward bulging may damage the container and may make it difficult or impossible to stack other containers on it.

For instance, one type of collapsible container includes an expandable outside member having four side panels foldably connected to a bottom section, and an expandable inside member having four reinforcing panels. In use, the outside member is opened so that this member forms a box that is open at one end; and the inside member is expanded and placed inside the outside member, with the reinforcing panels generally congruent and abutting against the side panels of the outside member so that the former panels support and reinforce the latter panels. The inside member also includes four top flaps, each one of which is foldably connected to a top edge of a respective one of the panels of the inside member.

The top flaps are positioned over the interior of the container; and, once the container is filled with product, a lid or cover is mounted on these top flaps, extending over the outside member of the container, to cover the product inside the container. If the side panels of the container bulge outwardly, those side panels may force the top flaps upward. If this occurs while the container is being filled, the flaps may prevent the lid from being properly seated on the container, and this may prevent this container from being used to support other containers. If the top flaps flip upward after the container is filled and covered, the flaps may tear the container lid, making it unsuitable for further use.

SUMMARY OF THE INVENTION

An object of this invention is to provide an improved collapsible container.

Another object of the present invention is to provide a collapsible container, of the type having collapsible corrugated side panels, with sufficient rigidity to hold dense particulate materials such as cereals and coffee.

A further object of this invention is to position a reinforcing member inside and abutting against the outside panels of a collapsible container to reinforce those outside panels, and to releasably connect together horizontal upper flaps of that reinforcing member to further strengthen the outside panels of the container against outward bulging forces.

Another object of the present invention is to selectively connect a plurality of clips to, and disconnect those clips from, overlapping horizontal portions of a collapsible container to reinforce the side panels of the container when desired without interfering with the way the container is collapsed and stored, or with the way the container is used to support a stack of like or similar containers.

These and other objectives are attained with a collapsible container comprising an outside member, an inside member and a lid member. The outside member includes a bottom section and four foldably interconnected outside panels that are connected to the bottom section for movement between an erected position and a collapsed position. In the collapsed position, the outside panels lie in a plane over and substantially parallel to that of the bottom section; and in the erected position, the outside panels extend upward from the bottom section, with adjacent side panels generally at a right angle to each other, and with the outside member forming a container interior to receive a product.

The inside member includes four reinforcing panels, and each of these panels includes an upper fold edge and an upper flap foldably connected to the upper fold edge of the panel. In the fully erected condition of the container, the inside member is positioned within the outside member, with the panels of the inside member abutting against the panels of the outside member, and with the upper flaps of the inside member extending inward from the fold edges of the reinforcing panels, generally horizontally and over the interior of the container. Preferably, lower sections of the reinforcing panels are substantially congruent with the side panels of the outside member. Connecting means, such as a plurality of clips, are provided to releasably connect together the upper flaps of the inside member in this fully erected condition of the container to hold those flaps generally horizontal and to further reinforce the reinforcing panels and the outside panels of the container against the weight of product inside the container. The lid member is releasably secured over the container interior to cover the product therein.

Further benefits and advantages of the invention will become apparent from a consideration of the following detailed description given with reference to the accompanying drawings, which specify and show preferred embodiments of the invention.

DETAILED DESCRIPTION OF THE PREFERRED EMBODIMENTS

Figure 1:
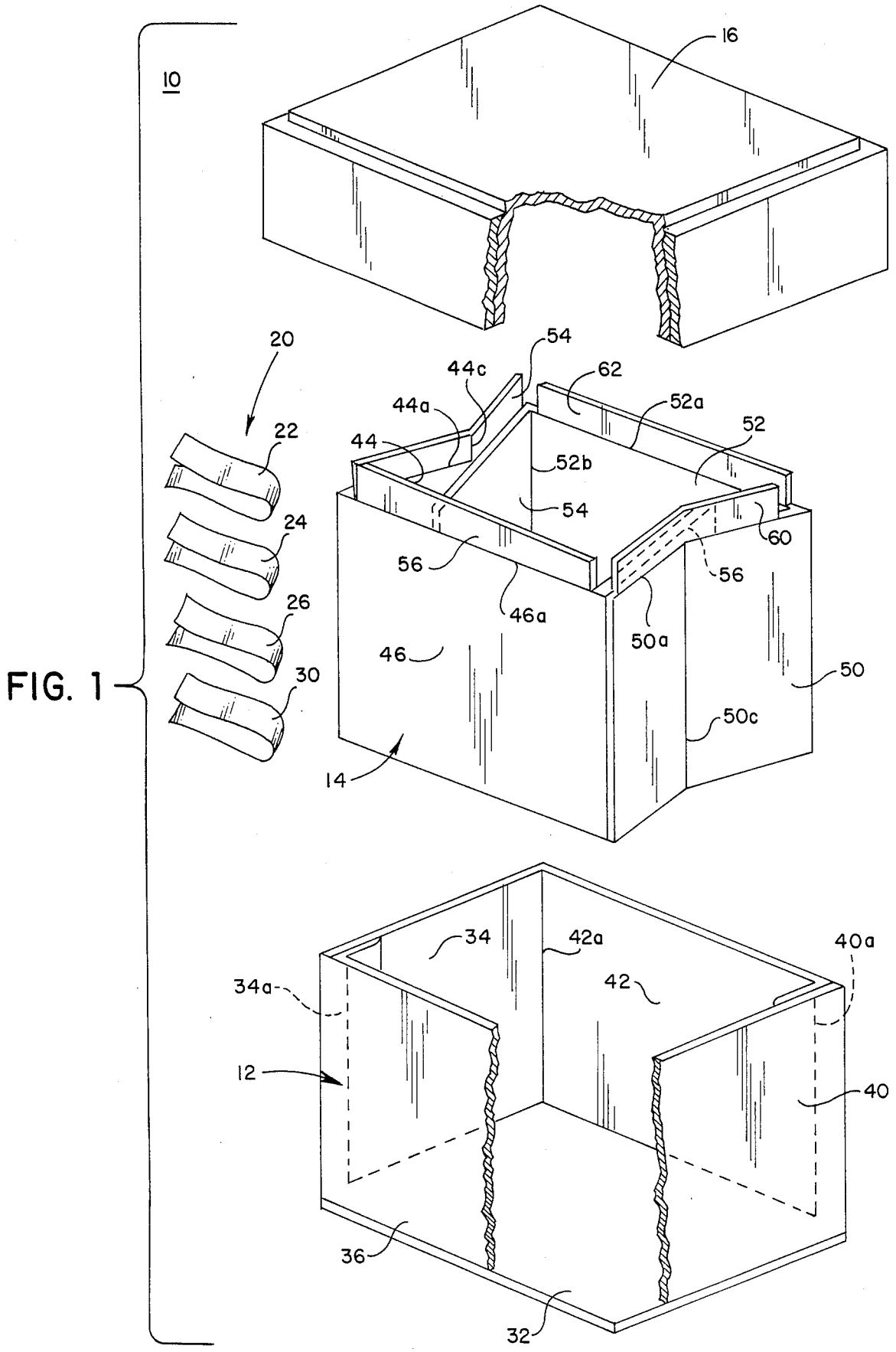
FIG. 1 is an exploded orthogonal view showing the elements of a collapsible container according to a preferred embodiment of the present invention, with some of the elements partially broken away.
Figure 2:
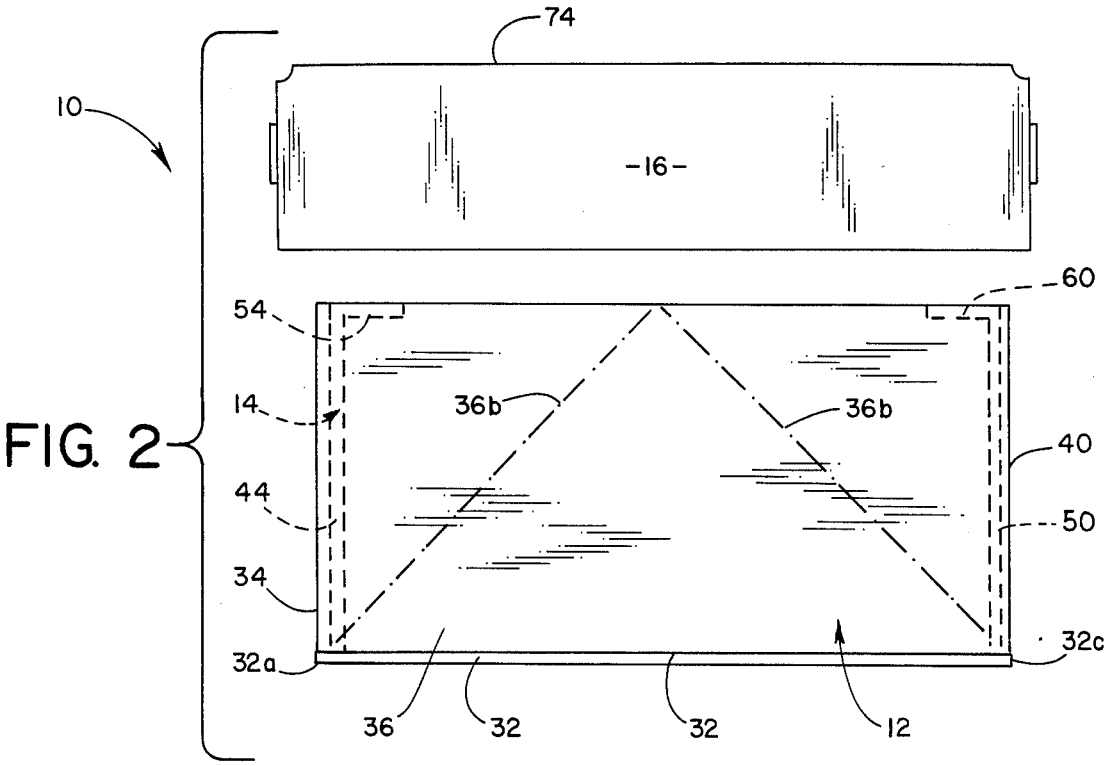
FIG. 2 is a side elevational view of the container illustrated in FIG. 1, showing the container in an open, erected position.
Figure 3:
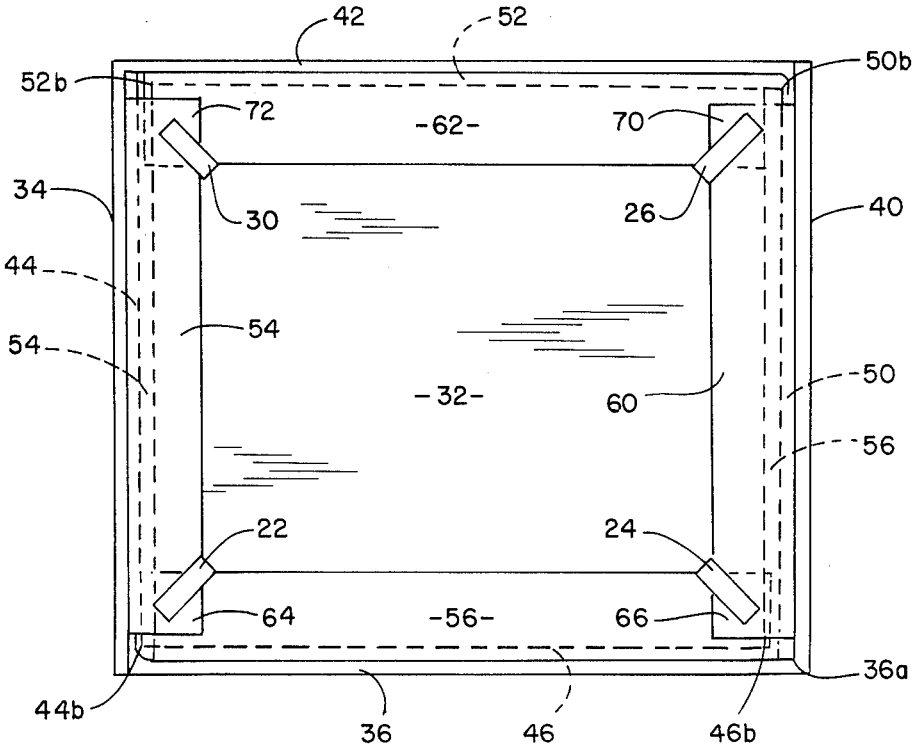
FIG. 3 is a top plan view of the container in the erected position, but with the lid thereof removed.

FIGS. 1–3 illustrate collapsible container 10 generally comprising outside member 12, inside member 14, cover or lid member 16, and connecting means 20; and this connecting means, in turn, preferably includes four clips 22, 24, 26 and 30. Generally, and with particular reference to FIG. 1, outside member 12 is used to form a box having an open top. Inside member 14 is formed into a rectangular or square shape and then nested into this box, inside of and against outside member 12, and thereby reinforcing the outside member. Then, clips 22, 24, 26 and 30 are used to connect together upper flaps of inside member 14, reinforcing that member and thereby further reinforcing outside member 12. Then, lid 16 is secured over members 12 and 14, covering the interior of container 10.

More specifically, outside member 12 includes bottom section 32 and four outside panels 34, 36, 40 and 42. Bottom section 32 has a flat, planar shape, and includes upper and lower surfaces and four peripheral edges, and three of these edges are referenced at 32*a*, 32*b* and 32*c* in FIG. 2. A pair of lip members (not shown) may be connected to a pair of adjacent edges, such as edges 32*b* and 32*c*, of bottom section 32 to facilitate engaging the bottom section by a fork lift, for example, as explained in U.S. Pat. No. 4,252,266. Bottom section 32 may be formed from a plurality of flaps that are connected together to form a planar bottom for container 10, or the bottom section 32 may be made from a single blank of material. Also, preferably bottom section 32 is made of fiber board, but it may be made of corrugated board or any other suitable material.

Figure 4:
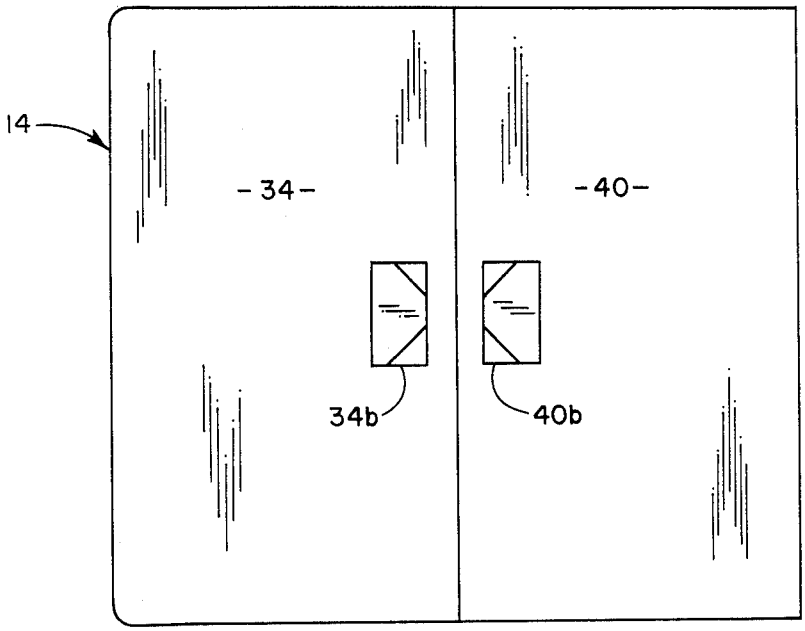
FIG. 4 is a top plan view showing the outside member of the container in a collapsed position.

Panels 34, 36, 40 and 42 are connected to bottom section 32 for movement between an erected position (shown in FIGS. 1–3) and a collapsed position (shown in FIG. 4). In the erected position, panels 34, 36, 40 and 42 vertically extend upward from bottom section 32 along a respective one of the peripheral edges of the bottom section, with adjacent panels generally at a right angle to each other; and in the collapsed position, panels 34, 36, 40 and 42 lie closely over and substantially parallel to bottom section 32. In the erected position, each of panels 34, 36, 40 and 42 has a flat, generally planar shape, and these panels are foldably interconnected at fold lines 34*a*, 36*a*, 40*a* and 42*a*.

The side panels of outside member 12 are provided with the appropriate fold lines (a pair of which are shown at 36*b* in FIG. 2) that permit the outside member to be folded between its erect and collapsed positions. Panels 34, 36, 40 and 42 of outside member 14 may be formed from a single blank of corrugated material that is provided with the appropriate fold lines to separate the blank into those panels, and that is foldably connected to bottom section 32 in any suitable manner, for example by gluing. Panels 34 and 40 may be provided with openings (shown at 34*b* and 40*b* in FIG. 4) to receive conventional clips (not shown) to hold lid element 16 in place.

Inside member 14 includes four reinforcing panels 44, 46, 50 and 52, and preferably the inside member includes additional panels 54 and 56. Each of panels 44, 46, 50 and 52 includes an upper fold edge 44*a*, 46*a*, 50*a* and 52*a*, respectively, and an upper flap 54, 56, 60 and 62, respectively, foldably connected to the upper fold edge of the panel. Cutouts (not shown) are preferably formed in member 14 so as to be substantially congruent with openings 34*b* and 40*b* of outside member 12 when member 14 is located inside that member 12.

Panels 44 and 46 are adjacent and foldably interconnected by fold line 44*b*, panels 46 and 50 are adjacent and foldably interconnected along fold line 46*b*, panels 50 and 52 are adjacent and foldably interconnected by fold line 50*b*, and panels 52 and 44 are adjacent and foldably interconnected along fold line 52*b*. Panel 54 is foldably connected to panel 52 via fold line 52*b*, and the former panel extends across panel 44; and similarly, panel 56 is foldably connected to panel 46 via fold line 46*b*, and panel 56 extends across panel 50.

The panels of member 14 are connected together for movement between an expanded position shown in FIG. 3, and a collapsed position. In the expanded position, panels 44, 46, 50, 52, 54 and 56 are all substantially planar, with adjacent pairs of the panels 44, 46, 50 and 52 generally at a right angle to each other. Also, in this position of member 14, panel 54 lies against panel 44, substantially congruent with a lower section thereof; and panel 56 lies against panel 50, substantially congruent with a lower section thereof. Preferably, panels 54 and 56 themselves do not have any fold lines and, thus, in the expanded position of member 14, panels 54 and 56 reinforce panels 44 and 50.

In the collapsed position of member 14, panels 46 and 52 are substantially planar, and parallel to and adjacent each other; and each of panels 44 and 50 is folded between panels 46 and 52, about a central fold line 44*c* and 50*c* respectively. Also, in this position of member 14, panel 56 lies directly against panel 46, between that panel and panels 44 and 50; and panel 54 lies directly against panel 52, between that panel and panels 44 and 50.

In the fully erected condition of container 10, inside member 14 is positioned within member 12, with panels 44, 46, 50 and 52 of the member 14 abutting against panels 34, 36, 40 and 42, respectively, of the outside member; and with upper flaps 54, 56, 60 and 62 extending inward from the upper fold edges of the reinforcing panels, generally horizontally and over the interior of container 10. Preferably, lower sections of panels 44, 46, 50 and 52 are substantially congruent with panels 34, 36, 40 and 42 respectively.

Also, in this fully erected condition of container 10, connecting means 20 releasably connects together upper flaps 54, 56, 60 and 62 to hold those flaps generally horizontal, and to further reinforce the panels of members 12 and 14 against the weight of material inside the container. Preferably, end portions of adjacent upper flaps overlap, forming overlapping sections 64, 66, 70 and 72; and one of the clips 22, 24, 26 and 30 is clamped onto each overlapping section to securely, but releasably, hold together the upper flaps forming that overlapping section.

More specifically, a first end portion of first upper flap 54 extends over a first end portion of second upper flap 56 and forms first overlapping section 64 therewith, and a second end portion of the second upper flap extends underneath a first end portion of third upper flap 60 and forms second overlapping section 66 therewith. Similarly, a second end portion of third upper flap 60 extends over a first end portion of fourth upper flap 62 and forms third overlapping section 70 therewith, and a second end portion of the fourth upper flap extends underneath a second end portion of first upper flap 54 and forms fourth overlapping section 72 therewith.

Clip 22 is releasably mounted on and clamps together the first end portions of first and second upper flaps 54 and 56, and clip 24 is releasably mounted on and clamps together the second end portion of the second flap 56 and the first end portion of third flap 60. Likewise, clip 26 is releasably mounted on and clamps together the second end portion of third flap 60 and the first end portion of fourth upper flap 62, and fourth clip 30 is releasably mounted on and clamps together the second end portions of first and fourth upper flaps 54 and 62.

Preferably, each of clips 22, 24, 26 and 30 is slideably mounted on the respective overlapping section, is held thereon by frictional engagement between the clip and that overlapping section, and clamps the portions of the upper flaps that form the overlapping section in a tight pressure engagement. Also, it is believed that best results are obtained when each of the upper flaps 56 and 62 is void of any fold lines between longitudinal ends of the upper flap, particularly transversely extending fold lines. Further, as will be understood, it does not matter whether the end portion of an upper flap extends over or under the adjacent end portion of the adjacent upper flap to form an overlapping section.

Figure 5:
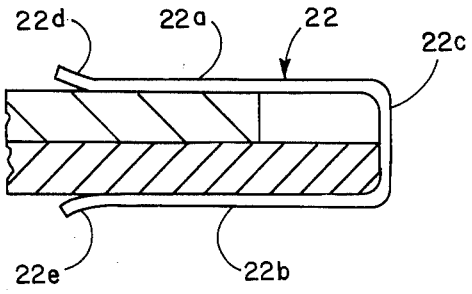
FIG. 5 is a side view showing one clip of the container in greater detail.

With the preferred embodiment of the invention, clips 22, 24, 26 and 30 are all identical, and FIG. 5 illustrates one clip 22 in greater detail. Clip 22 has a U-shape, including upper and lower legs 22*a* and 22*b* and a base portion 22*c* connecting together those legs. Each leg of the clip includes a distal end, spaced from the base portion of the clip; and to facilitate sliding the clip into and off from its assembled position on the upper flaps of reinforcing member 14, distal end 22*d* of upper leg 22*a* is upwardly curved and distal end 22*e* of lower leg 22*b* is downwardly curved. Clips 22, 24, 26 and 30 may be of various sizes and shapes, and may be made from any suitable material, for example plastic or stainless steel; and, of course, the clips should be compatible with the cargo or material loaded into container 10.

Lid member 16 includes generally flat, rectangular or square top wall 74 and four side walls extending outward from peripheral edges of the top wall, substantially perpendicular thereto. The height of these side walls is approximately equal to or greater than the combined height of outside member 12 and inside member 14 when these members 12 and 14 are both collapsed and the inside member rests on top of the outside member. In this way, lid member 16 is also effectively used as a protective covering for member 12 and member 14 when container 10 is in the collapsed position.

When empty, container 10 may be stored or transported in its collapsed position—that is, with outside member 12 in its collapsed position, with member 14 in its collapsed position and placed on top of the collapsed member 12, and with lid 16 seated on and covering both members 12 and 14. To erect container 10 for use, lid member 16 and inside member 14 are removed, outside member 12 is opened to the position shown in FIGS. 1–3; and inside member 14 is expanded and placed within member 12. Upper flaps 54, 56, 60 and 62 are positioned generally horizontally and over the interior of the container, and then these flaps are connected together by clips 22, 24, 26 and 30.

Once container 10 is erected, a product is loaded into the container in any suitable manner, for instance, by simply pouring the product through the open top of the container; and, after the container is loaded, lid member 16 is secured on the container, covering the product inside. Depending on the material that is loaded into the container, it may be desirable to line the interior of the container with a clean sanitary liner or film. Once container 10 is loaded and covered, it may be stored or transported, and a plurality of like or similar containers can be stacked one on top of another to conserve space.

Subsequently, to unload the product from container 10, lid member 16 is removed and the container is emptied in any suitable manner, for example, by simply pouring the product out of the container. Once the container is emptied, clips 22, 24, 26 and 30 are removed from upper flaps 54, 56, 60 and 62, and member 14 is removed from the container and collapsed. Outside member 12 is collapsed onto bottom 32, member 14, in its collapsed position, is placed on top of the collapsed outside member, and lid member 16 is placed over the members 12 and 14. Clips 22, 24, 26 and 30 may also be stored inside the collapsed container to ensure that the clips will be available the next time the container is erected.

The collapsible container of the present invention has been found to be very effective for holding dense, bulk cargo such as coffee beans, cereals, and gelatin powder. Clips 22, 24, 26 and 30 are very easy to install and remove, and can be done so in just a few seconds. At the same time, these clips effectively hold upper flaps 54, 56, 60 and 62 in a horizontal position, and thus help hold container 10 in its box shape. This, in turn, helps to set lid member 16 on the container and to stack a plurality of containers one.on top of another. Moreover, these clips do not interfere with such stacking of containers, nor do the clips interfere with the way the container is collapsed or erected.

Of course, many types of outside and inside members other than the members 12 and 14 specifically described above, may be used in the practice of this invention. For example, as shown in the drawings, the various panels of members 12 and 14 each comprises a single layer of material; however, as will be readily understood by those of ordinary skill in the art, the panels of members 12 and 14 may, instead, be constructed from a material having multiple plies.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

What is claimed is:

1. A collapsible container for holding a product, comprising:

an outside member including a bottom section and four foldably interconnected, planar outside panels, each of the outside panels being connected to and extending upward from the bottom section, with adjacent outside panels generally at a right angle to each other, and wherein the outside member forms a container interior to receive the product;

an inside member including four reinforcing panels positioned inside and abutting against the outside panels of the outside member, each of the reinforcing panels having an upper fold edge and an upper flap connected to the upper fold edge and extending inward, generally horizontally therefrom, over the container interior;

said upper flaps include a first, a second, a third, and a fourth upper flap;

first end portions of the first and second upper flaps overlap and form a first overlapping section;

a second end portion of the second upper flap and a first end portion of the third upper flap overlap and form a second overlapping section;

a second end portion of the third upper flap and a first end portion of the fourth upper flap overlap and forms a third overlapping section;

second end portions of the fourth and first upper flaps overlap and form a fourth overlapping section;

connecting means releasably connecting together the upper flaps to hold the upper flaps generally horizontal, and to hold the reinforcing panels and the outside panels vertical against the weight of the product;

said connecting means includes a first, a second, a third, and a fourth chip;

the first clip is releasably mounted on and clamps together the first end portions of the first and second upper flaps;

the second clip is releasably mounted on and clamps together the second end portion of the second flap and the first end portion of the third flap;

the third clip is releasably mounted on and clamps together the second end portion of the third clip and the first end portion of the fourth clip;

the fourth clip is releasably mounted on and clamps together the second end portions of the fourth and first upper flaps; and a lid member releasably secured and extending over the container interior to cover the product.

2. A collapsible container according to claim 1 wherein:

each of the clips is slideably mounted on the respective overlapping section, is held thereon by frictional engagement between the clip and the respective overlapping section, and clamps the portions of the upper flaps that form the overlapping section in a tight pressure engagement.

3. A collapsible container according to claim 2, wherein:

each of the clips includes upper and lower legs, and a base portion connecting together the upper and lower legs;

the upper leg of each clip is located on top of the respective overlapping section, and the lower leg of each clip is located below the respective overlapping section;

the upper leg of each clip includes a distal end, spaced from the base portion of the clip, and curving upward away from the respective overlapping section to facilitate sliding the clip onto and off from the respective overlapping section; and the lower leg of each clip includes a distal end, spaced from the base portion of the clip, and curving downward away from the respective overlapping section to further facilitate sliding the clip onto and off from the respective overlapping section.

4. A method for loading a product into and unloading the product from a collapsible container of the type including a collapsible outside member, a collapsible inside member, and a lid member, the outside member having a bottom section and four foldably interconnected outside panels connected to the bottom section, the inside member having four reinforcing panels, each of the reinforcing panels having an upper, foldable flap, the method comprising the steps of:

expanding the outside member and positioning the outside panels extending vertically upward from the bottom section wherein the outside member forms an interior to hold the product;

expanding the inside member and positioning the inside member inside the outside member, with the reinforcing panels abutting against the outside panels;

positioning the upper flaps of the inside member generally horizontal and over said interior; the step of positioning the upper flaps includes the steps of:

(i) overlapping a portion of a first upper flap with a portion of a second upper flap to form a first overlapping section, (ii) overlapping another portion of the second upper flap with a portion of a third upper flap to form a second overlapping section, (iii) overlapping another portion of the third upper flap with a portion of a fourth upper flap to form a third overlapping section, (iv) overlapping another portion of the fourth upper flap and another portion of the first upper flap to form a fourth overlapping section;

connecting together the upper flaps to hold the upper flaps generally horizontal and to reinforce the reinforcing panels and the outside panels;

the step of connecting together the upper flaps includes the steps of (i) sliding a first clip onto the first overlapping section to clamp together the first and second upper flaps, (ii) sliding a second clip onto the second overlapping section to clamp together the second and third upper flaps, (iii) sliding a third clip onto the third overlapping section to clamp together the third and fourth upper flaps, and (iv) sliding a fourth clip onto the fourth overlapping section to clamp together the fourth and first upper flaps; loading the product into the interior of the container;

securing the lid member over said interior to cover the product;

subsequently removing the lid member;

unloading the product from the container; and disconnecting the upper flaps from each other; the step of disconnecting the upper flaps includes the steps of (i) removing the first clip from the first overlapping section, (ii) removing the second clip from the second overlapping section, (ii) removing the third clip form the third overlapping section, and (iv) removing the fourth clip from the fourth overlapping section.

* * * * *